United States Patent [19]

Kinashi et al.

[11] Patent Number: 4,610,528

[45] Date of Patent: Sep. 9, 1986

[54] ELECTROPHOTOGRAPHIC COPYING MACHINE WITH DELAYED DEVELOPMENT BIAS VOLTAGE APPLICATION

[75] Inventors: Hiroshi Kinashi, Uji; Kozo Takahashi, Nara, both of Japan

[73] Assignee: Sharp Kabushiki Kaisha, Osaka, Japan

[21] Appl. No.: 591,583

[22] Filed: Mar. 20, 1984

[30] Foreign Application Priority Data

Mar. 30, 1983 [JP] Japan ..... 58-58518

[51] Int. Cl.[4] ..... G03G 15/09

[52] U.S. Cl. ..... 355/3 DD; 355/14 D; 118/657

[58] Field of Search ..... 355/3 DD, 14 D, 14 R; 118/647, 648, 657, 658; 430/103

[56] References Cited

U.S. PATENT DOCUMENTS 3,918,395 11/1975 Fearnside ..... 118/657 X
4,111,152 9/1978 Sakamoto ..... 118/658 X
4,484,811 11/1984 Nakahata et al. ..... 355/14 R X

*Primary Examiner*—Arthur T. Grimley
*Assistant Examiner*—J. Pendegrass
*Attorney, Agent, or Firm*—Birch, Stewart, Kolasch & Birch

[57] ABSTRACT

An electrophotographic copying machine comprises a developing device for visualizing an electrostatic latent image as a toner image by delaying applying a developing bias voltage between a magnet roller and a photoreceptor to prevent carriers of a developer from being transferred onto the photoreceptor.

4 Claims, 3 Drawing Figures

ELECTROPHOTOGRAPHIC COPYING MACHINE WITH DELAYED DEVELOPMENT BIAS VOLTAGE APPLICATION

BACKGROUND OF THE INVENTION

The present invention relates to an electrophotographic copying machine and, more particularly, to a developing device for visualizing an electrostatic latent image as a toner image in an electrophotographic copying machine.

An electrophotographic copying machine produces an electrostatic latent image on a photoreceptor with an optical system. The latent image corresponds to an image on a copy document such as a manuscript or book to be copied. A developing device is provided so that toner particles are electrically adhered to the latent image, wherein the latent image becomes visible as a toner image. The toner image is transferred onto a copy paper via a transference charger.

The conventional developer is a two-component developer comprising toner particles and magnetic particles called carriers, so that the developer is magnetically attracted by a magnet roller to form a magnetic brush in contact with the photoreceptor, which is called a magnetic brush developing system. Of course, it is most preferable that only the toner particles are transferred to the electrostatic latent image on the photoreceptor. However, the carriers may inadvertently be attached to image portions and non-image portions on the photoreceptor, thereby resulting in degradation of the copied image and damages in controlling the density of the developer. Accordingly, it is expected that the carriers are prevented from being attached to the photoreceptor.

Conventionally, to prevent the attachment of the carriers onto the photoreceptor, the following are controlled: voltage difference between the charging voltage of the photoreceptor and the developing bias voltage, the separation between the magnet roller and an element for controlling attachment of the developer onto the magnet roller, the separation between the magnet roller and the photoreceptor, charging amounts of change associated with the carriers, and relative limitations of the shapes and the sizes of the carriers.

However, the above-mentioned methods for preventing the attachment of the carriers onto the photoreceptor require narrow design conditions. For example, controlling the separation between the photoreceptor and the magnet roller, and the selection of the developing bias voltage etc. are extremely complex.

SUMMARY OF THE INVENTION

Accordingly, it is an object of the present invention to provide an improved developing device for visualizing an electrostatic latent image as a toner image while preventing carriers from being attached to a photoreceptor.

It is another object of the present invention to provide an improved developing device for visualizing an electrostatic latent image as a toner image by delaying application of a developing bias voltage between a magnet roller and a photoreceptor to prevent carriers from being transferred onto the photorceptor.

It is a further object of the present invention to provide an improved electrophotographic copying machine comprising a developing device for visualizing an electrostatic latent image as a toner image by delaying application of a developing bias voltage between a magnet roller and the developing device to prevent carriers from being transferred onto the photoreceptor, after the magnetic attraction of the carriers onto the magnet roller becomes normal.

Briefly described, in accordance with the present invention, an electrophtographic copying machine includes a developing device for visualizing an electrostatic latent image as a toner image by delaying application of a developing bias voltage between a magnet roller and a photoreceptor to prevent carriers of a developer from being transferred onto the photoreceptor.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE INVENTION

The attachment of magnetic particles called carriers to a photoreceptor is caused when the voltage gap between the photoreceptor and a magnet roller is great, namely, when electrostatic attraction between the charges on the photoreceptor and the carriers becomes greater than magnetic attraction between the carriers and the magnet roller. In particular, when the magnet roller is started, the carrier attachment onto the photoreceptor is caused due to the prevailing condition that charges are present on the photoreceptor whose polarity provides an electrostatic attraction between the carriers and the photoreceptor.

The present invention addresses the above-described fact. The movement of the developer positioned between the photoreceptor and the magnet roller is disturbed during the short time when the magnet roller is started, so that the magnetic attraction of the carriers to the magnetic roller becomes lower than in the normal condition. Therefore, when the developing bias voltage is applied prior to the energization of the magnetic roller, the electrostatic attraction of the carriers to the photoreceptor becomes stronger than the electrostatic attraction to the magnetic roller to thereby attract the carriers onto the photoreceptor. In view of this fact, according to the present invention, after the magnet roller is started, a developing bias voltage is applied between the magnet roller and the photoreceptor. The developing bias voltage is not applied prior to the magnetic attraction of the carrier to the magnet roller becoming normal, in order to prevent the carriers from being attracted by and transferred onto the photoreceptor.

Figure 1:
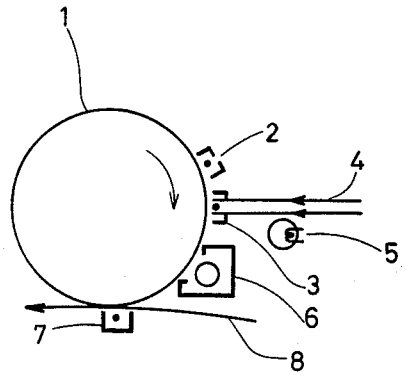
FIG. 1 shows a side view of essential parts of an electrophotographic copying machine according to the present invention.

Referring to FIG. 1, a three-layered photoreceptor 1 is disposed around a rotational drum. The photoreceptor 1 includes an electrically conductive base made of Al, a photoconductive layer made of CdS thereon, and an insulative layer made of MYLAR thereon. An example of such a three-layered element and an electrophotographic process therewith is disclosed in H. TA- NAKA et al, U.S. Pat. No. 3,666,363 issued on May 30, 1972, entitled ELECTROPHOTOGRAPHIC PROCESS AND APPARATUS. The disclosure of this patent is incorporated herein by reference. The present invention, however, should not be limited to this type of photoreceptor 1.

A first corona discharger 2 is provided for initially and uniformly charging the surface of the photoreceptor 1 in a certain polarity. A light exposing device may be provided for emitting light toward the document mounted on a document table as the document table is reciprocated in accordance with the rotation of the drum carrying the photoreceptor 1, so that the reflected light beams are incident onto the photoreceptor 1 through an optical system having mirrors and a lens to form an electrostatic latent image. A second AC corona discharger 3 is provided for passing the reflected light beams toward the photoreceptor 1 and, simultaneously, for providing an AC corona discharge having a polarity opposed to that of the first corona discharger 1. A magnetic brush developing device 6 is provided for attaching toner particles onto the electrostatic latent image of the photoreceptor 1. A charge removing lamp 5 is provided for emitting light beams toward the photoreceptor 1. A transfer discharger 7 is provided for corona transfering the toner image onto a copy paper. The copy paper is picked up from a number of copy papers as stored within a cassette. A plurality of paper pick-up rollers may be provided for picking up a single copy paper from the papers in the cassette. A plurality of paper feeding rollers may be provided for feeding the picked-up copy paper into the transference discharger 7 in a direction shown at 8.

Although not shown in FIG. 1, a first charge-removing corona discharger may be provided for charging the photoreceptor 1 in a polarity opposed to the polarity of the remaining charges on the photoreceptor 1 to remove the charges from the photoreceptor 1. A cleaning device may be provided for removing the remaining toner particles from the surface of the photoreceptor 1. A second charge-removing corona discharger may be provided for removing the remaining charges from the photoreceptor 1 to ready it for the next copying operation. A pair of fixing rollers may be provided for pressing the toner image onto the copy paper to fix the toner image thereon. A pair of exhaust rollers may be provided for expelling the copied paper from the body of the copying machine and place the copied paper onto an expel tray.

It is to be noted that the application of the present invention should not be limited to the copying machine of this type as shown in FIG. 1.

Figure 2:
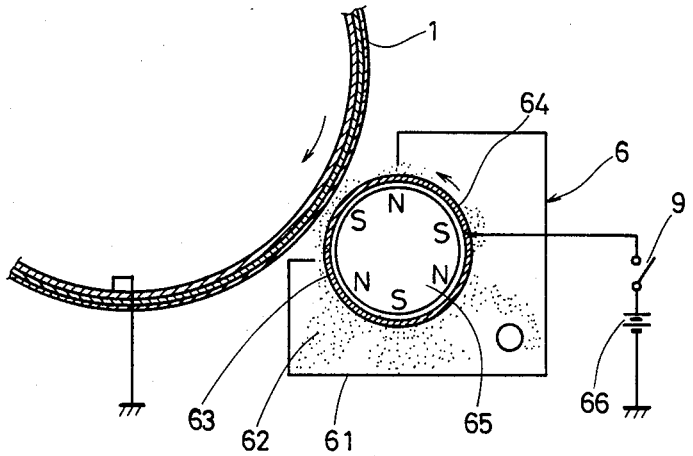
FIG. 2 shows a side view of a developing device according to the present invention.

Referring now to FIG. 2, the developing device comprises a developing chamber 61 accomodating a developer 62 including toner particles and carriers. The developer 62 is attracted to a cylindrical sleeve 64 forming a magnet roller 63. Within the sleeve 64, a magnet 65 is provided in which the polarities of magnetic portions are alternated. For example, by rotating the sleeve 64 while the magnet 65 is fixed, the developer 62 is transferred into developing portions of the sleeve 64 facing the photoreceptor 1. The sleeve 64 is made of a conductive and nonmagnetic material such as Al etc., grounded through a developing bias voltage 66. On the other hand, the electrically conductive base of the photoreceptor 1 is also grounded.

Figure 3:
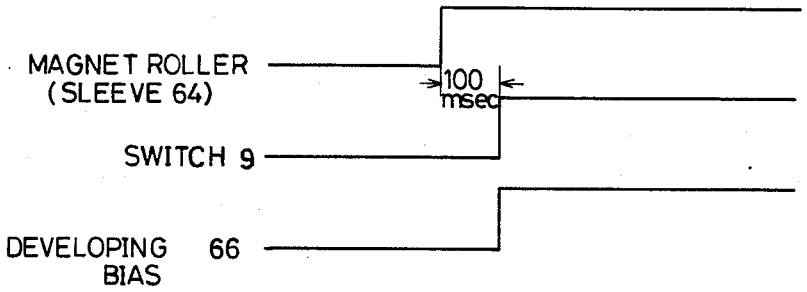
FIG. 3 shows a timing chart of signals occurring within the developing device of FIG. 2.

According to the present invention, the developing bias voltage 66 is applied to the sleeve 64 by a switch 9, for example, about 100 msec after the sleeve 64 is started to rotate. In the copying machine as shown in FIG. 1, by the exposure of the reflected light beams 4, it is selected, for example, that the bright image voltage on the photoreceptor 1 is about 150 V, the dark image voltage on the photoreceptor 1 is about 450 V, and non-image voltage on the photoreceptor 1 is about −350 V. Conventionally, when the developing bias voltage 66 is applied to the sleeve 64 prior to the activation of the magnet roller 63, the carrier may be attached onto the photoreceptor 1 when the bias voltage becomes about 150 V or more. However, as shown in FIG. 3, according to the present invention, when the rising of the developing bias voltage 66 is delayed by the switch 9 by about 100 msec after the activation of the magnet roller 63 (the rotation of the sleeve 64), no attachment of the carrier to the photoreceptor 1 will occur, even when the developing bias voltage becomes about 350 V or more in similar conditions.

The delaying time to apply the developing bias voltage 66 to the magnet roller 63 can be selected to be within about 20–300 msec in view of the delay of a clutch for rotating the sleeve 64, the mechanism transmission characteristics, and electrical characteristics by estimating that the attraction of the carriers to the sleeve 64 by the magnet 65 becomes stable with the rotation of the sleeve 64. In this manner, the developing process cannot be damaged.

While only certain embodiments of the present invention have been described, it will be apparent to those skilled in the art that various changes and modifications may be made therein without departing from the spirit and scope the present invention as claimed.

What is claimed is:

1. A developing device for an electrophotographic copying machine, comprising:

means for providing toner particles and carrier particles;

photoreceptor means for receiving said toner particles thereon to form an electrostatic latent toner image;

magnetic roller means, opposed to said photoreceptor means, for attracting said toner and carrier particles thereto and for applying said toner particles to said photoreceptor means, wherein said magnetic roller means includes a rotating sleeve and a magnet;

means for preventing the attraction of said carrier particles to said photoreceptor means by applying a delayed voltage to said rotating sleeve of said magnetic roller means to stabilize the attraction between said photoreceptor means and said magnetic roller means, wherein said voltage is delayed from about 20 to about 300 msec after said rotating sleeve starts to rotate.

2. A developing device according to claim 1, wherein said means for applying a delayed voltage is a switch.

3. A developing device according to claim 1, wherein said magnet is cylindrical and includes a plurality of alternating North and South polarities about the periphery thereof.

4. A developing device according to claim 1, wherein said photoreceptor means is grounded.

* * * * *